United States Patent [19]

Sato et al.

[11] Patent Number: 4,600,048

[45] Date of Patent: Jul. 15, 1986

[54] METHOD FOR CONTINUOUS CASTING OF METAL STRIP

[75] Inventors: Takashi Sato; Tsutomu Ozawa; Katsuhiro Minamida, all of Kawasaki, Japan

[73] Assignee: Nippon Steel Corporation, Tokyo, Japan

[21] Appl. No.: 764,780

[22] Filed: Aug. 12, 1985

[30] Foreign Application Priority Data

Aug. 13, 1984 [JP] Japan ..... 59-167910

[51] Int. Cl.[4] ..... B22D 11/06; B22D 27/04

[52] U.S. Cl. ..... 164/463; 164/479; 164/338.1

[58] Field of Search ..... 164/463, 423, 429, 479, 164/121, 338.1, 494, 505, 506, 250.1

[56] References Cited

U.S. PATENT DOCUMENTS 4,301,855 11/1981 Suzuki et al. ..... 164/423 X

*Primary Examiner*—Kuang Y. Lin

*Attorney, Agent, or Firm*—Wenderoth, Lind & Ponack

[57] ABSTRACT

A thin metal strip excellent in both shape and quality is produced by a continuous casting process which comprises the steps of jetting a molten metal through a nozzle onto the surface of a moving chill body maintained at a pertinent temperature range by irradiating a high density energy at a place positioned at the rear of the nozzle, and subjecting the molten metal to quenching so as to effect solidification.

5 Claims, 5 Drawing Figures

METHOD FOR CONTINUOUS CASTING OF METAL STRIP

BACKGROUND OF THE INVENTION

1. Field of the Invention

The present invention relates to a method for casting thin metal strip or wire directly from the molten metal by jetting the molten metal under pressure onto the surface of a moving chill body so as to effect quenching and solidification.

2. Description of the Prior Art

As continuous casting methods for producing thin metal strip or wire directly from the molten metal by quenching the molten metal (defined herein as including an alloy) there are known the centrifugal quenching method and the single roll method. These methods involve a step of jetting the molten metal onto the inside or outside circumferential surface of a rotating metallic drum, thereby quenching and solidifying the metal, thus casting a continuous metal thin strip (defined herein as including ribbon and wire) directly from the molten metal. The quenching rate is so high in these methods that it is possible to obtain an amorphous metal insofar as the alloy composition is selected properly. U.S. Pat. No. 4,221,257 discloses one example of the single roll method.

In the single roll method of the prior art, there are three main parameters which are known to require control during the continuous casting process:

(1) the pressure under which the molten metal is jetted;

(2) the moving speed of the chill body (such as a roll, drum or belt); and (3) the gap between the nozzle and the chill body.

In the process for continuous casting an amorphous metal, it has been customary to set these parameters on the basis of experience considering the shape of the nozzle opening (meaning the length in the moving direction in the case of a slot-shaped nozzle) and the target thickness of the product sheet.

For example, in the manufacture of a sheet about 30 μm thick from a metal alloy of the composition $Fe_{80.5}Si_{6.5}B_{12}C_1$ (atomic %) by using a 0.8 mm slot, the following three conditions are typically selected:

(1) jetting pressure: 0.22 $Kg/cm^2$;

(2) moving speed: 24 m/sec.; and (3) gap between the nozzle and the chill body: 0.15 mm.

However, with some kinds of alloy, no matter how the above parameters may be varied, it proves impossible to obtain a thin metal strip of the desired shape and size, or often even to obtain a continuous thin metal strip at all. Nor is this an uncommon situation in either the case of amorphous or polycrystalline metal strips.

For instance, in the production of a thin strip of silicon steel by means of the single roll casting method, a thin strip of good shape and surface quality cannot be obtained even when the casting parameters are set similarly to those for an amorphous alloy. The surface shape of the product thus manufactured is wavy and has longitudinal fractures, and further, the surface is very frequently so oxidized as to be disclosed. Similar phenomena are also found to take place in the case of stainless and carbon steels.

Also, in the case of amorphous alloys it has sometimes been impossible to produce a thin strip of high quality by the mere selection of the above three casting parameters. This is especially true in the case of Fe-based alloys containing a low percentage of Fe, which are generally brittle and have rough surfaces.

Thus, in the single roll method of the prior art, there are innumerable examples wherein a thin metal strip of the desired shape and quality cannot be produced by the mere proper selection of the above three conditions and the size of the nozzle opening.

SUMMARY OF THE INVENTION

It is a prime object of the present invention to provide a continuous casting method for producing a metal strip of excellent size and quality by quenching the molten metal.

It is another object of the invention to provide a continuous casting method for producing an amorphous metal strip of excellent shape and quality by quenching the molten metal.

BRIEF DESCRIPTION OF THE DRAWINGS

These and other objects of the invention will be better understood from the following detailed description with reference to the accompanying drawings, in which.

DETAILED DESCRIPTION OF THE INVENTION

Figure 1:
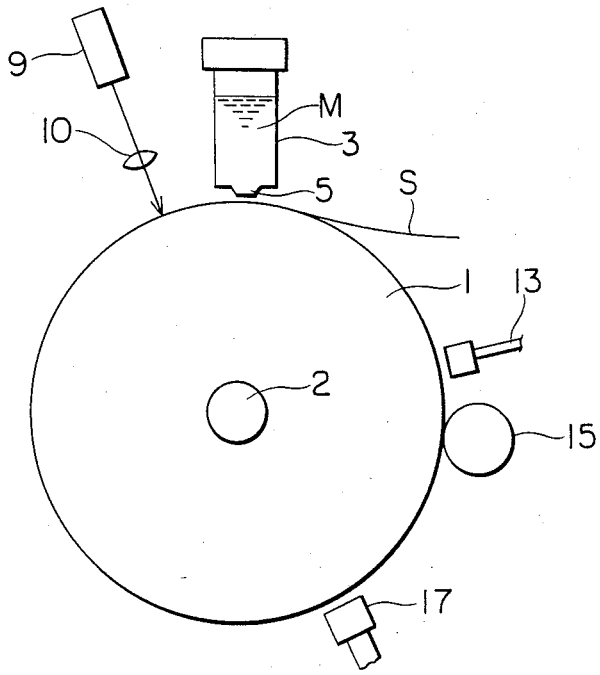
FIG. 1 is a schematic view of an apparatus for carrying out the method of the present invention.
Figure 2A:
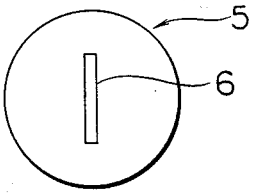
FIGS. 2*a*–2*d* are schematic views showing the configuration of various nozzle openings.
Figure 2B:
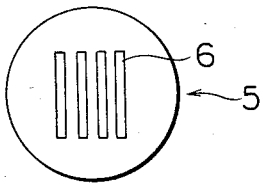
Figure 2C:
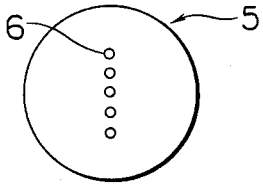
Figure 2D:
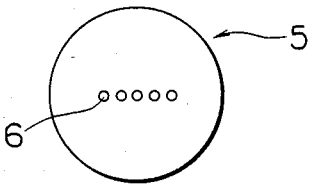

In accordance with the method of the present invention, a thin metal strip is produced by a casting process comprising jetting a molten metal under presure onto the surface of a moving chill body, thereby subjecting the molten metal to quenching and solidification.

The moving chill body is, for example, a single roll made of copper, copper alloy, ferrous alloy, or copper or copper alloy plated with nickel, iron or chromium. The chill body is provided on the outer circumference of an endless belt conveyor or on the inner circumference of a cylindrical metallic drum.

The nozzle used for jetting the molten metal under pressure is provided at its lower end with an opening positioned opposite the chill body. The form of the opening is selected from among those shown in FIG. 2 with consideration to the form, shape and size of the desired product. When a wide strip is to be cast, the nozzle opening is generally preferred to be a rectangular slot (a). If a wide and thick sheet is desired, a plurality of slots arranged in the direction of the chill body are used (b). For a flat wire, a nozzle with a round slot is used. When a large number of flat wires are to be produced at one time, a plurality of nozzles with round slots are arranged in the direction perpendicular to the moving direction of the chill body (c). If a round wire is to be cast, a plurality of round slot nozzles arranged in the moving direction of the chill body are preferred (d).

What characterizes the method of the present invention for casting a molten metal and producing a thin strip of alloy on the chill body is that the casting is carried out while the surface of the chill body is heated by a high-density thermal energy source which is capable of instantaneous heating.

It has been known heretofore to heat the surface of the chill body in the course of casting. This is described, for instance, in Japan Unexamined Patent Application (referred to as Japan Kōkai hereinafter) SHO-55 (1980) - 5111, which discloses a method for preheating a rotating chill roll using a preheater.

Moreover, Japan Kōkai No. SHO-59 (1984) - 35860 discloses a method in which the surface of a roll is maintained at the proper temperature by jetting a different molten material onto the roll surface prior to jetting the molten metal thereon. In addition, Japan Kōkai No. SHO-57 (1982) - 121860 discloses a method in which the surface temperature of a roll is kept above 115° C. by water-cooling the inside of the roll.

Similarly to these prior arts, the present invention is also directed to a method for casting a molten metal on a chill body while heating the chill body to keep its temperature within the proper range.

As the thermal energy source it is preferable to use, for instance, a laser beam, infrared beam or other high-energy density heat source, and it is further preferable that the heat be applied at the rear of the molten metal pool or puddle formed by the molten metal on the chill body, namely, the heat should be applied as near to the puddle as possible on the side opposite to the exit of the thin metal strip.

The temperature of the chill body surface is raised by the irradiation with the high-density thermal energy to an appropriate level for the type of metal to be cast.

The appropriate temperature $T_E$ of the chill body can be obtained, for instance, by the following formula:

$$12x-150<T_E<T_x-500+15x$$

where x refers to the total quantity (atomic %) of metalloid and $T_x$ to the start temperature (°C.) of crystallization of the alloy.

When the chill body is maintained at the appropriate temperature, the wettability between the molten metal and the chill body is improved and thus in turn enhances the thermal conduction so that the cooling rate is increased.

In the present invention, the reason for using a high density energy source such as a laser ray for heating the chill body is that it enables heating of only the surface layer of the chill body. The temperature-raising effect that can be obtained by using a low density energy source to heat the fast-moving chill body is small. The desired temperature can be obtained using a low density energy source only if the area of thermal contact is made large. In such case, however, since the chill body is generally made of a good thermal conductive material, the heat is diffused into the interior of the chill body so that the surface temperature is raised only slightly. Even if some way is found for raising the temperature to the required level using a low-density energy source, the result would be that not only the surface temperature but also the inside temperature would be raised so that the chill body would hardly be able to perform its chill function. Therefore in the present invention, a high density thermal source is applied.

Another advantage of a laser and infrared beams is that they are able to transmit energy through the air. Accordingly, the energy can be conferred to the chill body surface without any contact whatever with the high-speed moving chill body, making it possible to direct the energy to any desired location near the nozzle. In this case, a defocused laser beam is used. Further, it is preferable that the beam be given a rectangular cross section by use of a cylindrical lens.

It is another important requirement of the present invention that the high density energy be applied immediately to the rear of the puddle of molten metal. The farther the region of application is separated from the puddle, the greater the amount of heat diffused into the interior of the chill body, the lower the surface temperature raising effect, and the greater the deterioration of the chilling effect of the chill body. The most suitable position for applying the high density energy generally depends upon the density of the energy, the region to be irradiated, the surface temperature required, and the reflectivity of the chill body. Since the reflectivity depends largely on the surface condition of the chill body, the irradiation conditions should be determined independently for each casting operation taking account of the kind of chill body used and its surface roughness after polishing. Variation in reflectivity during casting can be measured in real time at another part of the chill body, and the irradiation conditions can be controlled on the basis of this measurement.

In general, the surface of the chill body is finished to be as smooth as possible. Therefore, when a $CO_2$ laser beam of long wave-length (wave-length: 10.6 μm) or an infrared beam (wavelength: about 1-1000 μm) is used, the beam is mirror-reflected by the chill body so that the energy absorption efficiency is low. Thus, in the present invention, a highly reflective concave mirror or plane mirror is provided in the vicinity of the chill body in order to enhance the effective absorptivity by utilizing the multiple reflection between the mirror and the chill body surface.

In accordance with the present invention, the irradiation of the chill body by a high density energy improves the cooling rate and also results in a large improvement of the surface condition of the thin strip. More specifically, the surfaces of the thin strip, both that on the side of the chill body and the free surface, are found to be very smooth. This seems to be brought about not only by the increased temperature on the chill body surface but also by the fact that the chill body surface is cleaned by the irradiation at a place near the puddle so that it comes in contact with the molten metal before being contaminated again. Another factor appears to be that the thermal expansion of the air layer adhering to the chill inhibits the formation of air pockets by entrained air.

FIG. 1 is a schematic view of an apparatus for carrying out the method of this invention.

A roll 1 made of a copper alloy is rotatably driven by a driving shaft 2. A crucible 3 is provided immediately above the roll 1 and the bottom of the crucible is provided with a nozzle 5. FIG. 2 shows various possible configurations of the opening 6 of the nozzle 5.

FIG. 2(*a*) shows a nozzle opening intended for making a thin strip of broad width; FIG. 2(*b*) shows another opening for making a thick strip of broad width; FIG. 2(*c*) shows an opening for making a flat wire; and FIG. 2(*d*) shows an opening for making a wire of round section. The arrow indicates the moving direction of the chill body.

A laser beam generator 9 is provided immediately to the rear (upstream) of the crucible 3 and the laser beam produced thereby is condensed onto the surface of the roll 1 via a condenser lens 10.

A cooling water blower 13 and a water drip roll 15 are provided downstream of the crucible 3, and an air blower 17 is arranged downstream thereof.

A molten metal M jetted from the nozzle 5 is quenched as soon as it comes in contact with the surface of the roll 1 to produce a flaked-off thin strip S. The roll from which the thin strip has flaked in cooled by cooling water supplied by the cooling water blower 13 and the water is removed from the roll 1 by the water drip roll 15 and the air blower 17 to dry the roll 1. The roll 1 is heated to the required temperature just in front of the crucible 3 by the laser beam. As a result, since the roll is at the proper temperature at the start of the casting of the molten metal, a metal strip having good and stable properties can be obtained. Moreover, the improved cooling capability tends to increase the maximum thickness to which it is possible to produce a sheet with amorphous molecular structure.

Figure 3:
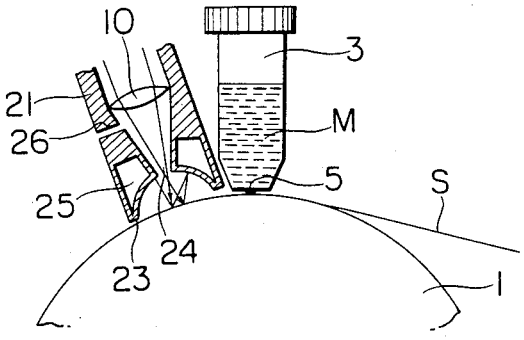
FIGS. 3 and 4 are explanatory views showing a method for enhancing the effective absorptivity of a laser beam.

FIG. 3 shows a view explaining how the effective absorptivity of the chill body surface is increased. As shown in FIG. 3, the laser apparatus is provided with a cylindrical casing 21 in which a condenser lens 10 is mounted. The bottom of the casing 21 is formed as a concave mirror 23 plated with gold. The laser beam is guided onto the surface of the roll 1 through a central aperture 24 of the concave mirror 23. The laser beam is condensed at the aperture 24 and the condensed laser beam irradiates the roll. The diameter of the aperture 24 should be larger than that of the laser beam and preferably should be approximately the same as that of the laser beam. A void 25 is provided at the rear of the concave mirror 23 and cooling water is introduced into the void 25. The casing 21 is further provided with a hole 26 through which an auxiliary gas such as nitrogen is introduced. The auxiliary gas is introduced between the surface of the roll 1 and the concave mirror 23 in order to prevent the surface of the roll 1 from being oxidized owing to the heat of the roll surface.

In the apparatus of the above construction, the laser beam impinging on the roll surface is repeatedly reflected between the roll surface and the concave mirror 23. As a result, almost all the energy of the laser beam projected onto the roll surface while the roll 1 passes below the concave mirror 23, is absorbed by the roll surface.

Figure 4:
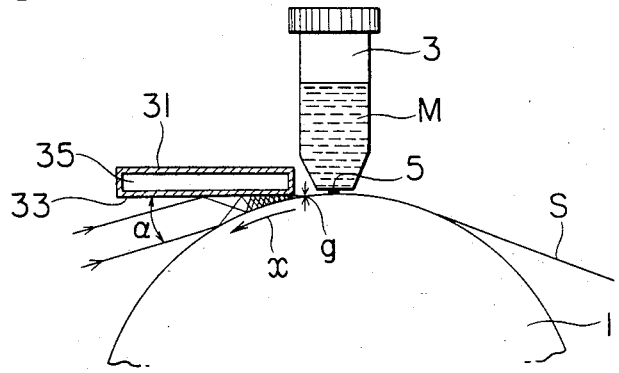

FIG. 4 shows another method for enhancing the effective absorptivity of the surface of the chill body. In this method, the laser beam irradiation apparatus is provided with a box-shaped mirror body 31 the bottom of which is formed or a gold-plated plane mirror 33 having a reflectivity of nearly one. A void 35 is formed inside the mirror body 31 and cooling water is introduced into the void 35.

One end of the mirror 31 is situated very near the nozzle 5 and is positioned such that the gap g between the roll surface and the end of the mirror is less than 0.1 mm. A laser beam condensed to a diameter of 3–5 mm, is projected onto the mirror face at an incident angle $\alpha$. The angle $\alpha$ is preferably 2–6 degrees.

As a result, the laser beam is repeatedly reflected between the roll surface and the plane mirror 33, and almost all of the laser beam energy is absorbed by the roll surface.

The effective absorptivity of the roll surface will now be explained.

Representing the supplied energy by $E_0$, the energy absorbed by the roll surface by $E_1$, and the absorptivity by $\alpha$, it follows that the effective absorptivity $\alpha_e$ is:

$$\alpha_e = E_1/E_0 \times 100\ (\%).$$

Since the laser beam is repeatedly reflected between the roll surface and the concave or plane mirror, the effective absorptivity $\alpha_e$ is:

$$\alpha_e = \alpha + (1-\alpha)\alpha + (1-\alpha)^2\alpha + \ldots \approx 1.$$

Figure 5:
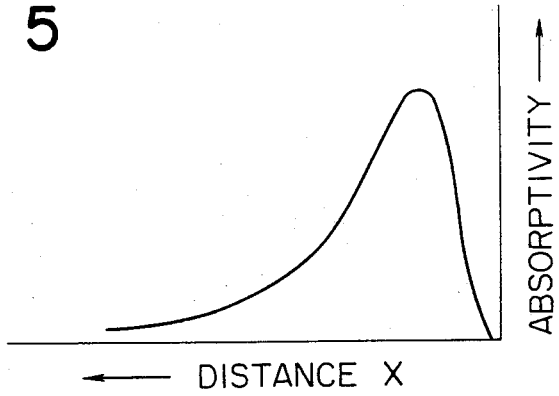
FIG. 5 is a graph showing an example of the relation between the location of the roll surface and the absorptivity.

FIG. 5 shows an example of the relationship between the distance x and the absorptivity, the distance x being measured outwardly along the roll surface from the apex of the V-throat formed by the plane mirror 33 and the roll as shown in FIG. 4.

The methods shown in FIGS. 3 and 4 can also be applied when using an infrared beam instead of a laser beam.

In the foregoing, the present invention is described chiefly in connection with the continuous casting of a metal strip. Needless to say, however, the invention can also be applied to the continuous casting of a ribbon, a wire or the like.

It is a feature of the present invention that only the surface layer of the chill body is rapidly heated by causing a high density energy to impinge on the chill surface in a region to the rear of the nozzle in order to keep the surface temperature of the chill body within the proper range in the course of casting. Accordingly, the wettability between the molten metal and the chill body is greatly improved so that heat is conducted rapidly from the molten metal into the chill body whereby the cooling rate of the molten metal is greatly increased. As a result, a thin strip or wire of good shape and quality can be obtained.

EXAMPLE

The apparatus shown in FIG. 4 was fabricated using a roll 1 made of a copper alloy and having a diameter 1000 mm and a width of 200 mm. A molten metal of the composition $Fe_{80.5}Si_{6.5}B_{12}C_1$ (atomic %) was jetted through a triple slot opening (d 0.4 mm, l 25 mm, and gap g 1 mm) to produce a thin strip. The casting conditions were: jetting pressure: 0.25 kg/cm$^2$; circumferential speed of the roll: 18 m/sec.; and gap between the roll 1 and the nozzle 5: 0.2 mm. The heating system was constituted as shown in FIG. 4 and the laser energy supplied was 15 KW. A thin strip 25 mm in width and 83 $\mu$m in thickness was cast. The thin strip was annealed at 380° C. for a period of 60 minutes in a magnetic field of 30 oersted. The magnetic property of the annealed strip was found to be as follows:

Magnetic density (at 1 oersted): 1.52 tesla

Core loss value (at 50 Hz, 1.3 tesla): 0.092 watt/kg

The temperature attained by the roll surface would not be measured because the gap between the mirror 31 and the nozzle 5 was extremely small.

What is claimed is:

1. In a method for casting a thin strip of metal directly from a molten metal by jetting the molten metal through a nozzle onto the surface of a moving chill body, quenching and solidifying the molten metal, an improved method which comprises the step of irradiating a high density energy beam onto the surface of said chill body at a region to the rear of said nozzle during said casting in order to rapidly heat only the surface of the chill body.

2. The method as claimed in claim 1 which comprises the step of heating said chill body by means of a laser beam.

3. The method as claimed in claim 1 which comprises the step of heating said chill body by means of an infrared beam.

4. The method as claimed in claim 1 which comprises the step of subjecting said irradiation energy beam to a multiple reflection by means of a concave mirror having an aperture of introduction.

5. The method as claimed in claim 1 which comprises the step of subjecting said irradiation energy beam to a multiple reflection by means of a plane mirror having an angle of incidence relative to the surface of said mirror.

* * * * *